US006579141B2

(12) United States Patent
Bayliss

(10) Patent No.: US 6,579,141 B2
(45) Date of Patent: Jun. 17, 2003

(54) NOVELTY ATTACHMENT FOR A DRINKS RECEPTACLE

(75) Inventor: Richard Bayliss, London (GB)

(73) Assignee: Spearmark International Ltd., Eaton Socon (GB)

( * ) Notice: Subject to any disclaimer, the term of this patent is extended or adjusted under 35 U.S.C. 154(b) by 0 days.

(21) Appl. No.: 09/793,523

(22) Filed: Feb. 27, 2001

(65) Prior Publication Data

US 2001/0023871 A1 Sep. 27, 2001

(51) Int. Cl.[7] ..... A63H 33/00

(52) U.S. Cl. ..... 446/200; 446/201; 239/33; 220/707

(58) Field of Search ..... 220/707; 239/33; 446/200, 201; 222/40

(56) References Cited

U.S. PATENT DOCUMENTS 3,315,405 A 4/1967 Hoffer
3,782,028 A 1/1974 Kelly
3,834,068 A 9/1974 Fabricant
4,252,273 A * 2/1981 Karterman ..... 239/33
4,579,281 A 4/1986 Karterman
5,393,258 A 2/1995 Karterman

* cited by examiner

*Primary Examiner*—Joseph M. Moy
(74) *Attorney, Agent, or Firm*—Antonelli, Terry, Stout & Kraus, LLP

(57) ABSTRACT

This invention relates to drinks receptacles and novelty attachments for drinks receptacles, particularly suitable for containing drinks for children. According to one embodiment of the invention there is provided a novelty attachment 60 for a drinking vessel 51 comprising a housing 61 defining a cavity 68, an inlet 70 to the cavity 68 and an outlet 73 from the cavity 68 spaced from the inlet 70, and a moveable member 63 mounted within the cavity 68, said member 63 moving when suction or pressure is applied to the outlet 73, wherein the cavity 68 has a first portion 65 and a second portion 67, the inlet 70 being attached to said first portion 65, the outlet 73 being attached to said second portion 67 and the moveable member 63 being located within the first portion 65.

The novelty attachment 60 according to the invention may be attached to a side of a drinking vessel 51, may be an integral part of the drinking vessel 51, or may be an integral part of a straw 71, 75 to be used with any type or shape of drinking vessel 51.

19 Claims, 1 Drawing Sheet

NOVELTY ATTACHMENT FOR A DRINKS RECEPTACLE

BACKGROUND

This invention relates to drinks receptacles and novelty attachments for drinks receptacles, particularly suitable for containing drinks for children.

SUMMARY

According to the present invention, there is provided a novelty attachment for a drinking vessel comprising a housing defining a cavity, an inlet to the cavity and an outlet from the cavity spaced from the inlet, and a moveable member mounted within the cavity, said member moving when suction or pressure is applied to the outlet, wherein the cavity has a first portion and a second portion, the inlet being attached to said first portion, the outlet being attached to said second portion and the moveable member being located within the first portion.

The housing may be a body portion of a lid for a drinking vessel or may be attached to and extend from a lid of such a vessel, or may be attached to a side of the vessel or rest on the straw in the vessel.

Preferably the lid further comprises means for attaching said lid to a drinking vessel and means for transporting liquid from a drinking vessel to which the lid is attached, to the inlet.

The transferring means may be a straw and a further straw may be connected to the outlet from the said lid.

Preferably the cavity is generally of elongate shape and the movable member has a central axis and is mounted for rotation in the first portion of the cavity.

Preferably in use, liquid drains from the first portion of cavity to the second portion of cavity under the force of gravity.

The moveable member is preferably a turbine member comprising a disc and a plurality of vanes extending generally radially outwardly from the axis of the disc, and preferably with a flat disc fixed concentrically to one or both sides of the vanes.

The said vanes may be curved or straight.

The inlet and outlet may be positioned 180° apart around the circumference of the cavity of the lid.

Preferably the inlet enters the cavity generally radially of the cavity and the outlet is arranged generally tangentially of the cavity.

Preferably a pictures novelty or other distraction is associated with the moveable member and is moved by that member.

In one embodiment a picture is fixed to or provided on a circular disc which is in turn fixed to the rotatable member.

The invention also provides a drinks receptacle comprising a drinking vessel in the form of a container for containing liquid open at one end and a lid as described above closing off said open end of the container.

Preferably the container is generally cylindrical.

BRIEF DESCRIPTION OF THE DRAWINGS

Further features and advantages of the invention will be apparent from the following description, by way of example of a preferred embodiment of the invention, the description being made with reference to the accompanying drawings in which.

DETAILED DESCRIPTION

Figure 1:
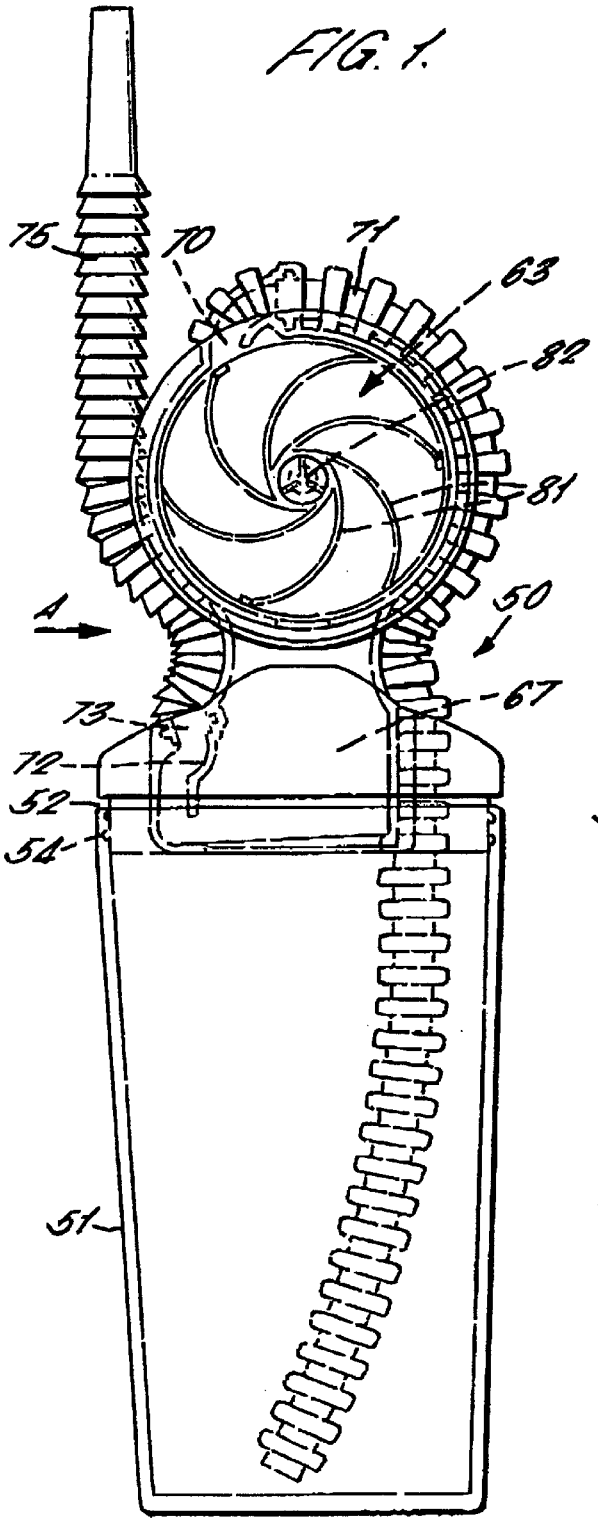
FIG. 1 is a side view of an embodiment of a drinks receptacle incorporating novelty attachment according to the invention.
Figure 2:
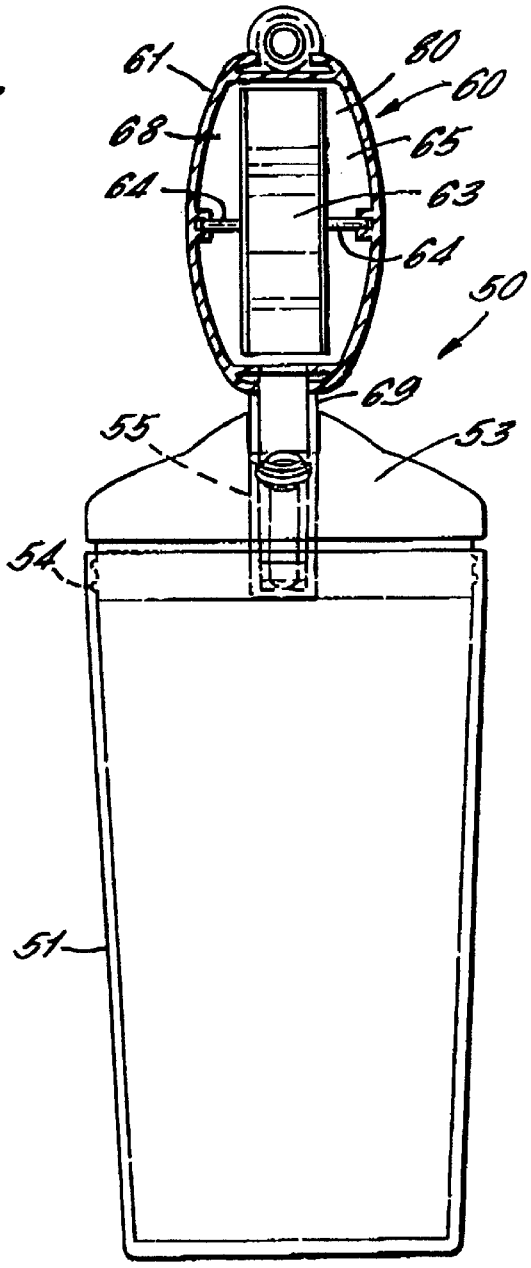
FIG. 2 is a view in the direction of arrow A in FIG. 1, with parts removed for clarity.

Referring to FIGS. 1 and 2 of the drawings, a drinks receptacle 50 comprises a drinking vessel or container 51 in the form of a cup of circular cross-section, generally cylindrical, and slightly tapered as shown in the drawings, and open at its open end 52.

The open end 52 of the container 51 is closed off by a lid 53 incorporating a housing of a novelty attachment, the details of which are described below. The lid has the domed shape shown in the drawings and includes a threaded portion 54 at its lower cylindrical end which allows the lid 53 to be attached to the container 51 by the screw threaded connection, although the attachment could equally be achieved by the use of a snap-on fit or the like.

The lid 53 includes a recess 55 of generally rectangular cross-section extending through the depth of the lid.

A novelty attachment 60 for the drinks receptacle comprises a housing 61 which encloses a cavity 68 having a first portion 65 and a second portion 67. In the first portion 65 there is mounted a turbine 63, Turbine 63 comprises at least one flat disc 80 having upstanding therefrom a series of vanes 81, which may be straight or curved, preferably arranged symmetrically around a central hub 82 and extending radially of the disc 80.

The turbine 63 includes axially projecting pins 64 by which it is mounted for rotation within the first portion 65 of the cavity 68 defined in the housing 61.

The housing 61 is formed in two parts along a generally vertical plane as shown in FIG. 2. The parts fit together to define the cavity 68 and also to define the second portion of said cavity 67 of generally rectangular cross-section. The lower end 69 of housing 61 which defines this second portion 67 is shaped so as to push fit or snap fit into recess 55. The interior of the second portion 67 is in communication with the first portion 65.

An inlet 70 to cavity 68 is formed at its upper part as shown in FIGS. 1 and 2. A flexible plastics tube or straw 71 is connected to the inlet 70 and extends around the outer profile of housing 61 as shown in FIG. 1, through lid 53 and into the interior of container 51 to a position adjacent the bottom of the container.

An interior wall 72 in the second portion 67 defines an outlet 73 from the housing 61. A second flexible straw 75 is connected to the outlet 73 and extends upwardly, terminating in a mouthpiece for a user. Both straws may be of corrugated plastics material or paper and of known type.

As shown in the drawings, the inlet 70 is spaced apart by approximately 180° around the periphery of the cavity 68 from the outlet 73.

In use, the drinks receptacle 51 is filled or partially filled with a liquid, for example water or juice. The lid 53 is then attached to the open end 52 of the container 51. The lid may be attached to the container by push-fit, by a screw threaded connection or other known means which secure the lid 53 on the container 51 whilst the drinks receptacle is in use.

The user sucks on the open end of straw 75, liquid is drawn up the straw 71 and enters the housing 61 through inlet 70. The liquid impinges on the blades 81 of turbine 63 causing the turbine to rotate and the liquid to drop into the second portion 67 of cavity 68 and then exit via outlet 73 through straw 75 to the user.

Rotation of the turbine 63 is caused by the water wheel principle. The turbine 63 is rotated by the liquid which hits the blades 81 of the turbine 63. The action of gravity on the liquid therefore causes the turbine 63 to move in a rotational direction. Gravity causes the liquid to drop from the blades 81 of the turbine 63 into the second portion of the cavity. In this way, the blades 81 continue to rotate after the user stops sucking on the open end of straw 75 as there is no liquid retained between the blades 81 to cause drag. The rotation of the turbine 63 will only decelerate due to frictional forces between the projecting pins 64 and the housing 61.

A picture or other novelty item may be fixed to one or both faces of turbine 63 which rotates with the turbine. This provides a distraction for the user of the receptacle and is particularly suitable for children. The housing 61 is preferably made from transparent plastics material so that the picture is visible to a user of the drinks receptacle.

In an alternative embodiment of the present invention, the novelty attachment 60 may be made as an integral part of a straw to be used in conjunction with any shaped drinking vessel. In this embodiment, straws 71, 75 are attached to inlet 70 and outlet 73 respectively and the housing 61 is not retained in a lid 53.

In use, the straw 71 attached to the inlet 70 is placed in to a cup, mug or any alternative drinking vessel containing a liquid. The whole housing 61 is then held by the user as the liquid is sucked from the drinking vessel 51 through the straw 71 by the user applying suction to the open end of straw 75, into the first portion 65 of the cavity 68 via inlet 70, causing the turbine 63 to rotate, and into the second portion 67 of the cavity 68 from where the fluid exits the housing via outlet 73 and straw 75.

It will be appreciated that the invention is not limited to the preferred embodiments described above and various modifications may be made within the scope of the claims. For example, the container 51 need not be a straight sided cylinder but may be tapered or have any other suitable shape usually found in drinking vessels. All the components of the drinks receptacle may be made from any suitable material although plastics materials, particularly transparent plastic, are particularly suitable.

The turbine 63 may have vanes 81 of any suitable form, straight or curved, and arranged at different angles both radially and axially. The picture fixed to the turbine as a distraction may be replaced by novelty or pictorial items moved by the turbine or moved by interaction with the turbine.

The housing containing the turbine may be attached to a side of the drinking vessel or it may be an integral part of the drinking vessel, or it may be an integral part of a straw for use with any drinking vessel.

What is claimed is:

1. A novelty attachment for a drinking vessel, comprising:

a housing defining a cavity having an inlet and an outlet, the outlet being spaced from the inlet, and a moveable member mounted within the cavity, said member moving when suction or pressure is applied to the outlet, characterised in that the cavity has a first portion and a second portion, said second portion being adapted to be generally below said first portion during normal use of said novelty attachment so that liquid drains from said first portion to said second portion, the inlet being attached to said first portion, the outlet being attached to said second portion, said moveable member being mounted for rotation within said first portion, and said movable member having a central axis of rotation which is, during normal use, substantially horizontal.

2. A novelty attachment as claimed in claim 1 further comprising means for transporting liquid from a drinking vessel to which the novelty attachment is attached, to the inlet.

3. A novelty attachment as claimed in claim 2 wherein the means for transferring the liquid from the drinking vessel to the inlet is a straw.

4. A novelty attachment as claimed in claim 3 wherein a further straw is connected to the outlet.

5. A novelty attached as claimed in claim 1, wherein, in the position of normal use, liquid drains from said first portion of the cavity to said second portion of the cavity under the force of gravity or by suction.

6. A novelty attachment as claimed in claim 1, wherein the cavity is generally elongate in shape.

7. A novelty attachment as claimed in claim 6 wherein the moveable member is a turbine member comprising a flat disc.

8. A novelty attachment as claimed in claim 7 in which a plurality of vanes extend generally radially outwardly from the axis of the disc.

9. A novelty attachment as claimed in claim 8 in which the said vanes are curved or straight.

10. A novelty attachment as claimed in claim 6 in which the inlet and outlet are positioned substantially 180° apart around the circumference of the cavity.

11. A novelty attachment as claimed in claim 1 in which a picture, novelty or other distraction is associated with the moveable member and is moved by that member.

12. A novelty attachment as claimed in claim 11 in which a picture is fixed to or provided on a circular disc which is in turn fixed to the moveable member.

13. A novelty attachment as claimed in claim 1 in which the housing is a body portion of a lid for a drinking vessel.

14. A novelty attachment as claimed in claim 1 in which the housing is attached to and extends from a lid for a drinking vessel.

15. A novelty attachment as claimed in claim 13 further comprising means for attaching said lid to a drinking vessel.

16. A novelty attachment as claimed in claim 14 further comprising means for attaching said lid to a drinking vessel.

17. A lid for a drinking vessel comprising a novelty attachment as claimed in claim 1.

18. A drinks receptacle comprising a drinking vessel in the form of a container for containing liquid, the container being open at one end, and a lid as claimed in claim 17 closing off said open end of the container.

19. A drinks receptacle as claimed in claim 18 in which the container is generally cylindrical.

* * * * *